US009543138B2

(12) United States Patent
Vestal et al.

(10) Patent No.: US 9,543,138 B2
(45) Date of Patent: Jan. 10, 2017

(54) ION OPTICAL SYSTEM FOR MALDI-TOF MASS SPECTROMETER

(71) Applicant: Virgin Instruments Corporation, Sudbury, MA (US)

(72) Inventors: Marvin L. Vestal, Framingham, MA (US); Kevin Hayden, Newton, MA (US)

(73) Assignee: Virgin Instruments Corporation, Marlborough, MA (US)

( * ) Notice: Subject to any disclaimer, the term of this patent is extended or adjusted under 35 U.S.C. 154(b) by 361 days.

(21) Appl. No.: 14/462,146

(22) Filed: Aug. 18, 2014

(65) Prior Publication Data

US 2015/0048245 A1 Feb. 19, 2015

Related U.S. Application Data

(60) Provisional application No. 61/867,375, filed on Aug. 19, 2013.

(51) Int. Cl.
*H01J 49/40* (2006.01)
*H01J 49/04* (2006.01)

(52) U.S. Cl.
CPC ..... *H01J 49/403* (2013.01)

(58) Field of Classification Search
CPC ..... H01J 49/40; H01J 49/067; H01J 49/164; H01J 49/04; H01J 49/06; H01J 49/403; H01J 4/004; H01J 49/0045; H01J 49/0072; H01J 49/0086; H01J 49/0095; H01J 49/0418; H01J 49/061; H01J 49/107; H01J 49/401; H01J 49/408; H01J 49/421; H01J 49/4235; G21K 1/087; G21K 5/05

(Continued)

(56) References Cited

U.S. PATENT DOCUMENTS 4,960,992 A 10/1990 Vestal et al.
5,087,815 A 2/1992 Schultz et al.

(Continued)

FOREIGN PATENT DOCUMENTS

JP 2010-251174 A 11/2010
JP 2013-041699 A 2/2013

(Continued)

OTHER PUBLICATIONS

"Notification of Transmittal of the International Search Report and the Written Opinion of the International Searching Authority, or The Declaration" for PCT/US2014/051507, Nov. 26, 2014, 15 pages, Korean Intellectual Property Office, ISA/KR, Daejeon Metropolitan City, Republic of Korea.

(Continued)

*Primary Examiner* — David A Vanore
(74) *Attorney, Agent, or Firm* — Kurt Rauschenbach; Rauschenbach Patent Law Group, LLC

(57) ABSTRACT

An ion accelerator for a time-of-flight mass spectrometer includes a pulsed ion accelerator positioned proximate to a sample plate and having an electrode that is electrically connected to the sample plate. An accelerator power supply generates an accelerating potential on the ion accelerator electrode that accelerates a pulse of ions generated from the sample positioned on the sample plate. An ion focusing electrode is positioned after the pulsed ion accelerator. A potential applied to the ion focusing electrode focuses the pulse of ions into a substantially parallel beam propagating in an ion flight path. A static ion accelerator is positioned proximate to the ion focusing electrode with an input that receives the pulse of ions focused by the ion focusing electrode. The static ion accelerator accelerating the focused pulse of ions.

31 Claims, 14 Drawing Sheets

(58) Field of Classification Search
USPC ..... 250/282, 287, 281, 288, 423 R, 396 R,250/424, 252.1, 285, 286, 290, 292, 397, 492.3
See application file for complete search history.

(56) References Cited

U.S. PATENT DOCUMENTS

| | | | | |
|---|---|---|---|---|
| 5,144,127 | A | 9/1992 | Williams et al. | |
| 5,160,840 | A | 11/1992 | Vestal | |
| 5,166,518 | A | 11/1992 | Freedman | |
| 5,625,184 | A | 4/1997 | Vestal et al. | |
| 5,627,369 | A | 5/1997 | Vestal et al. | |
| 5,847,385 | A | 12/1998 | Dresch | |
| 6,057,543 | A | 5/2000 | Vestal et al. | |
| 6,300,627 | B1 | 10/2001 | Koster et al. | |
| 6,489,610 | B1 | 12/2002 | Barofsky et al. | |
| 6,512,225 | B2 | 1/2003 | Vestal et al. | |
| 6,534,764 | B1 * | 3/2003 | Verentchikov | H01J 49/40 250/282 |
| 6,621,074 | B1 | 9/2003 | Vestal | |
| 6,872,941 | B1 | 3/2005 | Whitehouse et al. | |
| 7,176,454 | B2 * | 2/2007 | Hayden | H01J 49/164 250/252.1 |
| 7,214,320 | B1 | 5/2007 | Gregori et al. | |
| 7,223,966 | B2 | 5/2007 | Weiss et al. | |
| 7,355,169 | B2 | 4/2008 | McLuckey et al. | |
| 7,498,588 | B1 | 3/2009 | Gordon et al. | |
| 7,564,026 | B2 | 7/2009 | Vestal | |
| 7,564,028 | B2 | 7/2009 | Vestal | |
| 7,589,319 | B2 | 9/2009 | Vestal | |
| 7,663,100 | B2 | 2/2010 | Vestal | |
| 7,667,195 | B2 | 2/2010 | Vestal | |
| 7,709,789 | B2 * | 5/2010 | Vestal | H01J 49/40 250/281 |
| 7,932,491 | B2 | 4/2011 | Vestal | |
| 8,003,934 | B2 * | 8/2011 | Hieke | H01J 49/04 250/281 |
| 8,399,828 | B2 * | 3/2013 | Vestal | H01J 49/0072 250/281 |
| 8,461,521 | B2 * | 6/2013 | Vestal | H01J 49/403 250/287 |
| 8,471,201 | B2 * | 6/2013 | Hieke | H01J 49/04 250/281 |
| 8,674,292 | B2 * | 3/2014 | Vestal | H01J 49/403 250/287 |
| 9,330,896 | B2 * | 5/2016 | Sano | H01J 49/061 |
| 2002/0158194 | A1 | 10/2002 | Vestal et al. | |
| 2003/0111597 | A1 | 6/2003 | Gonin et al. | |
| 2003/0141447 | A1 | 7/2003 | Verentchikov et al. | |
| 2003/0180807 | A1 | 9/2003 | Hess et al. | |
| 2004/0119012 | A1 | 6/2004 | Vestal | |
| 2004/0203175 | A1 | 10/2004 | Li et al. | |
| 2004/0213721 | A1 | 10/2004 | Arno et al. | |
| 2005/0035285 | A1 | 2/2005 | Tan et al. | |
| 2005/0092918 | A1 | 5/2005 | Smith et al. | |
| 2005/0116162 | A1 | 6/2005 | Vestal | |
| 2005/0242279 | A1 | 11/2005 | Verentchikov | |
| 2005/0269505 | A1 | 12/2005 | Ermer | |
| 2005/0279933 | A1 | 12/2005 | Appelhans et al. | |
| 2006/0266941 | A1 * | 11/2006 | Vestal | H01J 49/0418 250/288 |
| 2008/0067349 | A1 | 3/2008 | Moskovets et al. | |
| 2008/0078931 | A1 | 4/2008 | Vestal et al. | |
| 2008/0272291 | A1 | 11/2008 | Vestal | |
| 2009/0194678 | A1 * | 8/2009 | Wiedenbeck | H01J 49/4235 250/282 |
| 2009/0294658 | A1 | 12/2009 | Vestal et al. | |
| 2010/0181473 | A1 | 7/2010 | Blenkinsopp et al. | |
| 2010/0276585 | A1 | 11/2010 | Lehmann | |
| 2010/0301202 | A1 | 12/2010 | Vestal | |
| 2011/0049350 | A1 | 3/2011 | Vestal | |
| 2011/0121171 | A1 | 5/2011 | Clemmer et al. | |
| 2011/0155901 | A1 | 6/2011 | Vestal | |
| 2011/0266431 | A1 * | 11/2011 | Vestal | H01J 49/0045 250/282 |
| 2012/0074313 | A1 | 3/2012 | Blick et al. | |
| 2012/0112056 | A1 | 5/2012 | Brucker et al. | |
| 2012/0145893 | A1 | 6/2012 | Vestal | |

FOREIGN PATENT DOCUMENTS

| | | | |
|---|---|---|---|
| WO | 00-77823 | A2 | 12/2000 |
| WO | 2004-030025 | A1 | 4/2004 |
| WO | 2006-064280 | A2 | 6/2006 |
| WO | 2010-138781 | A2 | 12/2010 |

OTHER PUBLICATIONS

"Notification Concerning Transmittal of International Preliminary Report on Patentability (Chapter I of the Patent Cooperation Treaty)" for PCT/US14/051507, Mar. 3, 2016, 12 pages, The International Bureau of WIPO, Geneva, Switzerland.

"Notification Concerning Transmittal of International Preliminary Report on Patentability" for PCT/US2012/025761, Sep. 6, 2013, 6 pages, The International Bureau of WIPO, Geneva, Switzerland.

"Notification of Transmittal of the International Search Report and The Written Opinion of The International Searching Authority, or The Declaration" for PCT/US2013/028953, Jun. 27, 2013, 13 pages, Korean Intellectual Property Office, Daejeon Metropolitan City, Republic of Korea.

"Notification Concerning Transmittal of International Preliminary Report on Patentability" for PCT/US2011/063855, Jun. 27, 2013, 8 pages, The International Bureau of WIPO, Geneva, Switzerland.

Notification Concerning Transmittal of International Preliminary Report on Patentability (Chapter I of the Patent Cooperation Treaty) for PCT/US2013/028953, Sep. 14, 2014, 9 pages, The International Bureau of WIPO, Geneva, Switzerland.

"Notification of Transmittal of The International Search Report and the Written Opinion of The International Searching Authority, or The Declaration" for PCT/US2014/019762, Jun. 16, 2014, 10 pages, The International Searching Authority/KR, Daejeon Metropolitan City, Republic of Korea.

"Notification of Transmittal of The International Search Report and The Written Opinion of The International Searching Authority, or The Declaration" for PCT/US2012/025761, Sep. 25, 2012, 9 pages, International Searching Authority/KR, Daejeon Metropolitan City, Republic of Korea.

"Notification of Transmittal of The International Search Report and The Written Opinion of The International Searching Authority, or The Declaration" for PCT/US2011/063855, Jul. 27, 2012, 11 pages, Intellectual Searching Authority/Korea, Korean Intellectual Property Office, Daejeon Metropolitan City, Republic of Korea.

"Notification Concerning Transmittal of International Preliminary Report on Patentability (Chapter I of The Patent Cooperation Treaty" for PCT/US2010/060902, Jul. 12, 2012, 7 pages, The International Bureau of WIPO, Geneva, Switzerland.

Beavis, Ronald C., et al., Factors Affecting the Ultraviolet Laser Desorption of Proteins, Rapid Communications in Mass Spectrometry, 1989, pp. 233-237, vol. 3 No. 9, Heyden & Son Limited.

Bergmann, T., et al., High-Resolution Time-of-Flight Mass Spectrometer, Rev. Sci. Instrum., Apr. 1989, pp. 792-793, vol. 60, No. 4, American Institute of Physics.

Beussman, Douglas J., et al., Tandem Reflectron Time-of-Flight Mass Spectrometer Utilizing Photodissociation, Analytical Chemistry, Nov. 1, 1995, pp. 3952-3957, vol. 67, No. 21, American Chemical Society.

Colby, Steven M., et al., Space-Velocity Correlation Focusing, Analytical Chemistry, Apr. 15, 1996, pp. 1419-1428, vol. 68, No. 8, American Chemical Society.

Cornish, Timothy J., et al., A Curved Field Reflectron Time-of-Flight Mass Spectrometer for the Simultaneous Focusing of Metastable Product Ions, Rapid Communication in Mass Spectrometry, 1994 pp. 781-785, vol. 8, John Wiley & Sons.

(56) References Cited

OTHER PUBLICATIONS

Cornish, Timothy J., et al., Tandem Time-of-Flight Mass Spectrometer, Analytical Chemistry, Apr. 15, 1993, pp. 1043-1047, vol. 65, No. 8.
Hillenkamp, F., Laser Desorption Mass Spectrometry: Mechanisms, Techniques and Applications, 1989, pp. 354-362, vol. 11A, Heyden & Son, London.
Kaufmann, R., et al., Mass Spectrometric Sequencing of Linear Peptides by Product-Ion Analysis in a Reflectron Time of-Flight Mass Spectrometer Using Matrix Assisted Laser Desorption Ionization, Rapid Communications in Mass Spectrometry, 1993, pp. 902-910, vol. 7, John Wiley & Sons, Ltd.
Mamyrin, B.A. et al., The Mass-Reflectron, A New Nonmagnetic Time-of-Flight Mass Spectrometer With High Resolution, Sov. Phys. 1973, pp. 45-48, vol. 37 No. 1, American Institute of Physics.
Matsuda, H., et al., Particle Flight Times Through Electrostatic and Magnetic Sector Fields and Quadrupoles to Second Order, International Journal of Mass Spectrometry and Ion Physics, 1982, pp. 157-168, vol. 42, Elsevier Scientific Publishing Company, Amsterdam, The Netherlands.
Neuser, H.J., et al., High-Resolution Laser Mass Spectrometry, International Journal of Mass Spectrometry and Ion Process, 1984, pp. 147-156, vol. 60, Elsevier Science Publishers B.V., Amsterdam, The Netherlands.
Vestal, M.L., et al. Delayed Extraction Matrix-Assisted Laser Desorption Time-of-Flight Mass Spectrometry, Rapid Communications in Mass Spectrometry, 1995, pp. 1044-1050, vol. 9, John Wiley & Sons, Ltd.
Vestal, M.L., et al. Resolution and Mass Accuracy in Matrix Accuracy in Matrix-Assisted Laser Desorption Ionization-Time-of-Flight, American Society for Mass Spectrometry, 1998, pp. 892-911, Elsevier Science, Inc.
Vestal, M., High Performance MALDI-TOF Mass Spectrometry for Proteomics, International Journal of Mass Spectrometry, 2007, pp. 83-92.
Wiley, W.C., et al., Time-of-Flight Mass Spectrometer With Improved Resolution, The Review of Scientific Instruments, Dec. 1955, pp. 1150-1157, vol. 26, No. 13.
Zhou, J. Kinetic Energy Measurements of Molecular Ions Ejected Into an Electric Field by Matrix-Assisted Laser Desorption, Rapid Communications in Mass Spectrometry, Sep. 1992, pp. 671-678, vol. 6, John Wiley & Sons, Ltd.
"Notification of Transmittal of the International Search Report and the Written Opinion of the International Searching Authority, or The Declaration" for PCT/US2010/022122, Aug. 16, 2010, 9 pages, International Searching Authority, Korean Intellectual Property Office, Seo-gu, Daejeon, Republic of Korea.
"Notification Concerning Transmittal of International Preliminary Report on Patentability (Chapter I of the Patent Cooperation Treaty)" for PCT/US2009/045108, Dec. 9, 2010, 9 pages, The International Bureau of WIPO, Geneva, Switzerland.
"Notification of Transmittal of The International Search Report and The Written Opinion of The International Searching Authority, or The Declaration" for PCT/US2010/046074, Apr. 15, 2011, 8 pages, International Searching Authority, Korean Intellectual Property Office, Seo-gu, Daejeon, Republic of Korea.
"Notification of Transmittal of The International Search Report and The Written Opinion of The International Searching Authority, or The Declaration" for PCT/US2010/036501, Jan. 4, 2011, 9 pages, International Searching Authority, Korean Intellectual Property Office, Seo-gu, Daejeon, Republic of Korea.
"Notification Concerning Transmittal of International Preliminary Report on Patentability (Chapter I of the Patent Cooperation Treaty)" for PCT/US2010/046074, Mar. 8, 2012, 5 pages, The International Bureau of WIPO, Geneva, Switzerland.

* cited by examiner

800
$D_V$
$D_S$
$d_1$
$d_2$
$d_3$
$a_1$
$a_2$
$a_3$
802
804
806
808
810

850
0
-V
$V_f$
854
853
τ
852
$V_{EP}$
858
Field dV/dx=0

870
0
-V
$V_f$
874
873
τ
872
0
876
Field dV/dx

| Geometry | | | Potentials | |
|---|---|---|---|---|
| | | | Sample Plate | 0 |
| Source | 23mm | | V1 | -2000 |
| d1 | 5mm | | V2 | -12500 |
| d2 | 11mm | | V | -20000 |
| Aperture V1 | 5mm | | | |
| Aperture V2 | 5mm | | | |

Extraction Applied
Potential gradient following application of accelerating pulse

ION OPTICAL SYSTEM FOR MALDI-TOF MASS SPECTROMETER

CROSS REFERENCE TO RELATED APPLICATION SECTION

The present application claims priority to U.S. Provisional Patent Application No. 61/867,375, filed on Aug. 19, 2013, entitled "Mass Spectrometry Method and Apparatus for Diagnostic Applications in a Clinical Laboratory." The entire content of U.S. Provisional Patent Application No. 61/867,375 is herein incorporated by reference.

The section headings used herein are for organizational purposes only and should not to be construed as limiting the subject matter described in the present application in any way.

INTRODUCTION

Time-of-Flight (TOF) mass spectrometers are well known in the art. Wiley and McLaren described the theory and operation of TOF mass spectrometers more than 50 years ago. See W. C. Wiley and I. H. McLaren, "Time-of-Flight Mass Spectrometer with Improved Resolution", Rev. Sci. Instrum. 26, 1150-1157 (1955). During the first two decades after the discovery of TOF mass spectrometry, TOF mass spectrometer instruments were generally considered a useful tool for exotic studies of ion properties, but were not widely used to solve analytical problems.

Numerous more recent discoveries, such as the discovery of naturally pulsed ion sources (e.g. plasma desorption ion source), static Secondary Ion Mass Spectrometry (SIMS), and Matrix-Assisted Laser Desorption/Ionization (MALDI), have led to renewed interest in TOF mass spectrometer technology. See, for example, R. J. Cotter, "Time-of-Flight Mass Spectrometry: Instrumentation and Applications in Biological Research," American Chemical Society, Washington, D. C. (1997), which describes the history, development, and applications of TOF-MS in biological research.

More recently, work has focused on developing new and improved TOF instruments and software that allow the full potential mass resolution of MALDI to be applied to difficult biological analysis problems. The discoveries of electrospray (ESI) and MALDI removed the volatility barrier for mass spectrometry. Electrospray mass spectrometers developed very rapidly, at least in part due to the ease in which these instruments interfaced with commercially available quadrupole and ion trap instruments that were already widely employed for many analytical applications. Applications of MALDI to TOF instruments have developed more slowly, but the potential of MALDI has stimulated development of improved TOF instrumentations that are specifically designed for MALDI ionization techniques.

Recently, Matrix Assisted Laser Desorption/Ionization Time-of-Fight Mass (MALDI-TOF) Spectrometry has become an established technique for analyzing a variety of nonvolatile molecules including proteins, peptides, oligonucleotides, lipids, glycans, and other molecules of biological importance. While MALDI-TOF spectrometry technology has been applied to many analytical applications, widespread acceptance has been limited by many factors, including, for example, the cost and complexity of these instruments, relatively poor reliability, and insufficient performance, such as insufficient speed, sensitivity, resolution, and mass accuracy.

Different types of TOF analyzers are required for different analytical applications depending on the properties of the molecules to be analyzed. For example, a simple linear analyzer is preferred for analyzing high mass ions, such as intact proteins, oligonucleotides, and large glycans, while a reflecting analyzer is required to achieve sufficient resolving power and mass accuracy for analyzing peptides and small molecules. Determining the molecular structure by MS-MS techniques requires yet another analyzer. In some commercial instruments, all of these types of analyzers are combined in a single instrument. Such combined instruments have the advantage of reducing the cost somewhat, relative to owning and operating three separate instruments. However, these combined instruments have the disadvantage of there being a substantial increase in instrument complexity, a reduction in reliability, and other compromises that make the performance of all of the analyzers less than optimal.

BRIEF DESCRIPTION OF THE DRAWINGS

The present teaching, in accordance with preferred and exemplary embodiments, together with further advantages thereof, is more particularly described in the following detailed description, taken in conjunction with the accompanying drawings. The skilled person in the art will understand that the drawings, described below, are for illustration purposes only. The drawings are not necessarily to scale, emphasis instead generally being placed upon illustrating principles of the teaching. The drawings are not intended to limit the scope of the Applicant's teaching in any way.

DESCRIPTION OF VARIOUS EMBODIMENTS

Figure 1:
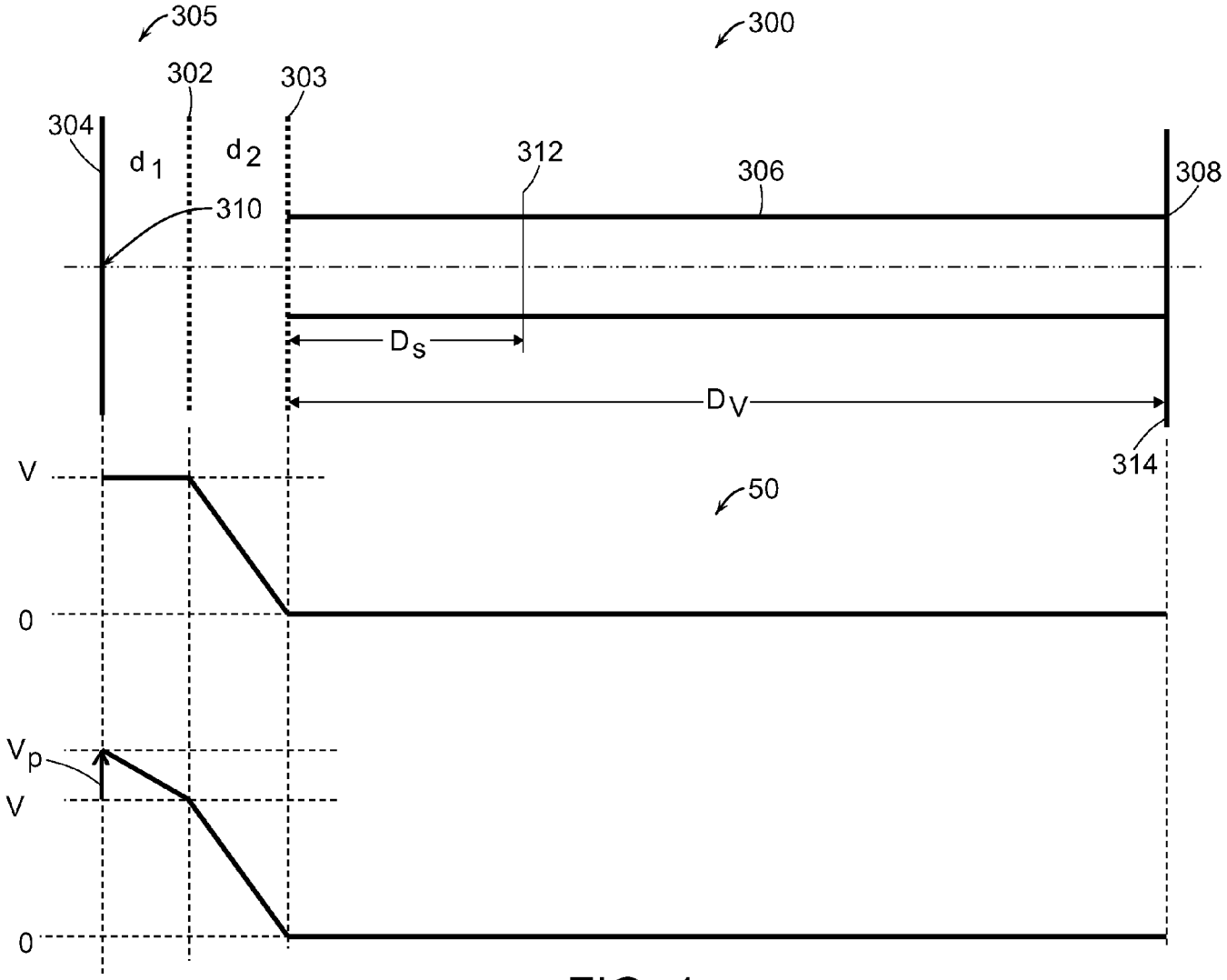
FIG. 1 illustrates a potential diagram showing the operation of a known matrix assisted laser desorption/ionization time-of-flight (MALDI-TOF) mass spectrometer.

Reference in the specification to "one embodiment" or "an embodiment" means that a particular feature, structure, or characteristic described in connection with the embodiment is included in at least one embodiment of the teaching. The appearances of the phrase "in one embodiment" in various places in the specification are not necessarily all referring to the same embodiment.

It should be understood that the individual steps of the methods of the present teachings may be performed in any order and/or simultaneously as long as the teaching remains operable. Furthermore, it should be understood that the apparatus and methods of the present teachings can include any number or all of the described embodiments as long as the teaching remains operable.

The present teaching will now be described in more detail with reference to exemplary embodiments thereof as shown in the accompanying drawings. While the present teachings are described in conjunction with various embodiments and examples, it is not intended that the present teachings be limited to such embodiments. On the contrary, the present teachings encompass various alternatives, modifications and equivalents, as will be appreciated by those of skill in the art. Those of ordinary skill in the art having access to the teaching herein will recognize additional implementations, modifications, and embodiments, as well as other fields of use, which are within the scope of the present disclosure as described herein.

The present teaching relates to a mass spectrometer method and apparatus that is suitable for performing routine analyses on selected analytes in a clinical or diagnostic laboratory. Examples of such systems are described in, for example, U.S. Pat. No. 8,735,810 entitled "Time-of-Flight Mass Spectrometer with Ion Source and Ion Detector Electrically Connected," U.S. patent application Ser. No. 13/415,802, entitled "Tandem Time-of-Flight Mass Spectrometry with Simultaneous Space and Velocity Focusing," and U.S. Pat. No. 8,674,292, entitled "Reflector Time-of-Flight Mass Spectrometry with Simultaneous Space and Velocity Focusing." The entire specification of U.S. Pat. Nos. 8,735,810 and 8,674,292, and U.S. patent application Ser. No. 13/415,802 are herein incorporated by reference. Such an instrument provides the required accuracy, resolution, sensitivity, and dynamic range to provide the information required to perform the selected assay with a specified performance. In some embodiments of the present teaching, such an instrument is fully automated and requires little or no training or experience on the part of the operator. Also, in some embodiments of the present teaching, the system is self-contained in a single cabinet, except for an external computer in particular embodiments. In some embodiments, the system is small and light enough to fit comfortably on a standard laboratory bench in a clinical laboratory. The instrument can be compatible with either manual and/or automated sample preparation equipment and procedures that are routinely employed in a clinical or diagnostic laboratory. In various embodiments, the results are both presented in a form specified by the clinician and are accessible from remote computers. Also, in many embodiments, the speed of the analysis does not limit sample throughput. The instrument according to the present teaching has many features, such as that it is relatively simple, reliable, and robust, and generally requires no tuning to obtain stable and predictable results.

Many analytical applications, such as tissue imaging and biomarker discovery, require measurements on intact proteins over a very broad mass range. For these applications, mass range, mass sensitivity over a broad mass range, speed of analysis, reliability, and the ease-of-use of the instrument are more important metrics than the instrument's resolving power. One aspect of the present teaching is a mass spectrometer that provides optimum performance for these and similar applications, and that is more reliable, easier to use, and less expensive.

FIG. 1 illustrates a potential diagram 50 showing the operation of a known matrix assisted laser desorption/ionization time-of-flight (MALDI-TOF) mass spectrometer. Some structure of the MALDI-TOF mass spectrometer is shown in the potential diagram for clarity. The known MALDI-TOF mass spectrometer comprises a MALDI sample plate 304 for supporting the sample in a vacuum housing (not shown). A pulsed ion accelerator 305 is located in a source housing where a pulse of energy, such as a laser pulse, is directed to the sample plate 304 to ionize the MALDI sample, thereby producing a pulse of ions that separates according to the ions' mass-to-charge ratios in the TOF analyzer. A vacuum generator maintains a high vacuum in the source housing and in the analyzer housings. A high voltage generator applies a high voltage to the sample plate 304 in order to accelerate the ions. An ion detector 308 detects the pulse of ions.

The potential diagram 50 for a linear TOF instrument 300, according to the prior art of Wiley and McLaren, is illustrated in FIG. 1. This design is the basis for many known linear TOF instruments, except that in some cases the grids 302, 303 are replaced with apertured electrodes. A high voltage is applied to either sample plate 304 or to first grid 302. An accelerating pulse is applied to either the sample plate 304 or the first grid 302. A static electric field is applied between the first and second grids 302, 303 to further accelerate the ions. Flight tube 306 and grid 303 are at ground potential.

The ions are focused in time at the detector 308 by adjusting the electrical fields and time delay between the laser pulse and the acceleration pulse. Equations for calculating the focus conditions were derived by Wiley and McLaren and are known in the art. While this known linear TOF instrument system provides time focusing, the system does not focus the ion beam into a parallel beam. The focal distances are given by the following equation:

$$D_s=2d_1yf[y^{1/2}-(d_2/d_1)/(1+y^{1/2})]2d_1yf(d_2), \text{ and } D_v-D_s=(2d_1y)^2/(v_n\tau),$$

where $y=(V+V_p)/V_p$, and $f(d_2)$ is the effective length of the second acceleration of length $d_2$. Focal length $D_s$ corresponds to the distance that ions travel in the field-free drift space. The flight time to the focal length $D_s$ for ions produced with zero initial velocity is independent (to first order) of the initial position. The focal length $D_v$ corresponds to the distance that ions travel in the field-free drift space, wherein the flight time to that distance for ions produced with different initial velocities is independent (to first order) of the initial velocity.

Figure 2:
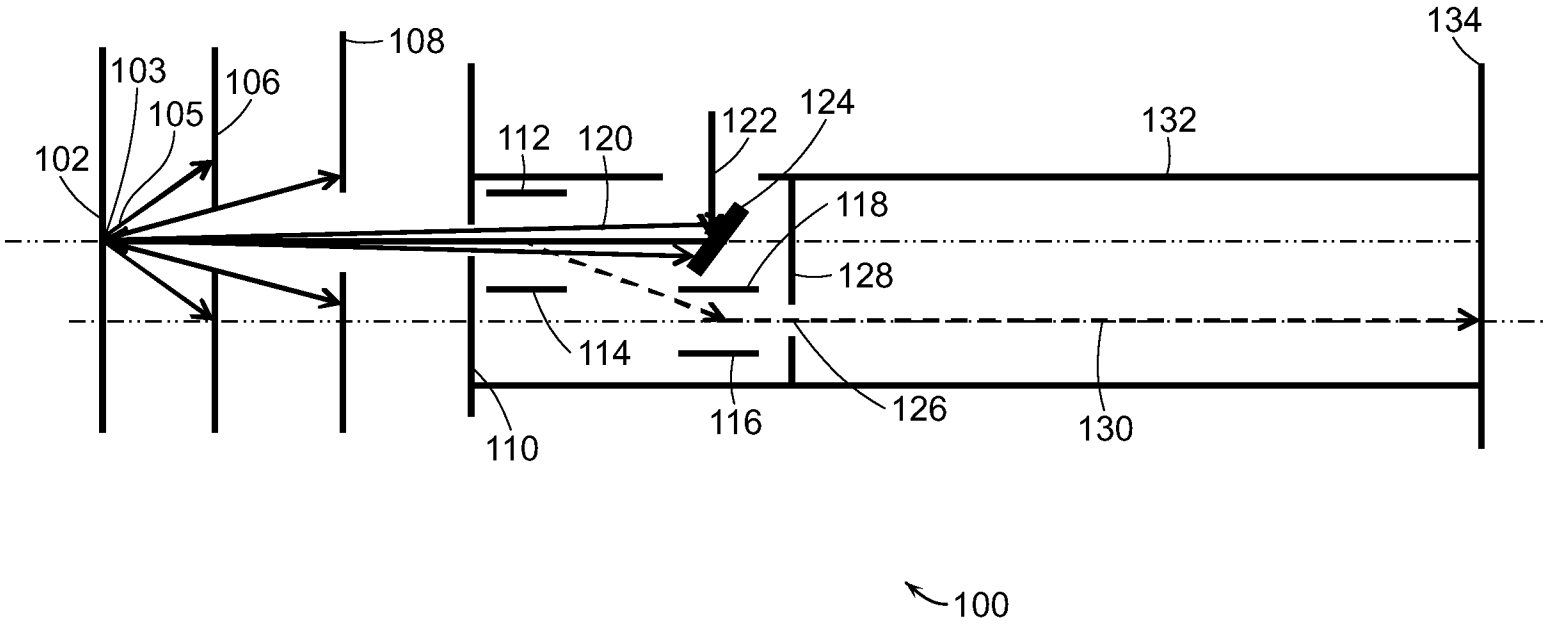
FIG. 2 is a schematic diagram of an ion optical system for a matrix assisted laser desorption/ionization time-of-flight (MALDI-TOF) mass spectrometer according to one embodiment of the present teaching.

FIG. 2 is a schematic diagram of an ion optical system 100 for a matrix assisted laser desorption/ionization time-of-flight (MALDI-TOF) mass spectrometer, according to one embodiment of the present teaching. A sample plate 102 that positions a sample 103 for analysis is electrically connected to ground potential. A pulse of energy, such as a laser pulse, is directed at the sample 103 positioned on the sample plate 102 so that it impinges on the sample 103 for analysis. The pulse of energy produces a pulse of ions 105 and a plume of neutral molecules during impact. In one embodiment, a laser beam 122 generated by a laser 123 (FIG. 3) is reflected by a mirror 124 so that it travels within a small angle coaxial with the ion beam produced by the laser.

The pulse of ions 105 is accelerated by an accelerating field formed between an acceleration electrode 106 and the sample plate 102. In one particular embodiment, a pulsed acceleration voltage is applied to the acceleration electrode 106 and static acceleration voltages are applied to both a focusing electrode 108 and a final acceleration electrode 110. A first set of deflection electrodes 112 and 114 and a second set of deflection electrodes 116 and 118 deflect a selected portion of the pulse of ions 130 away from a beam of neutrals 120 and directs selected pulse of ions 130 through an aperture 126 in a baffle 128, and then into a field-free evacuated drift region 132. The pulse of ions 130 travels through an evacuated field-free region 132 and is focused in time at focal position 134. In a linear MALDI-TOF analyzer configuration, an ion detector is positioned at focal position 134. In a reflector MALDI-TOF analyzer configuration, focal position 134 comprises a first focal position for an ion mirror. In a TOF-TOF analyzer configuration, a timed-ion-selector is positioned at focal position 134.

Figure 3:
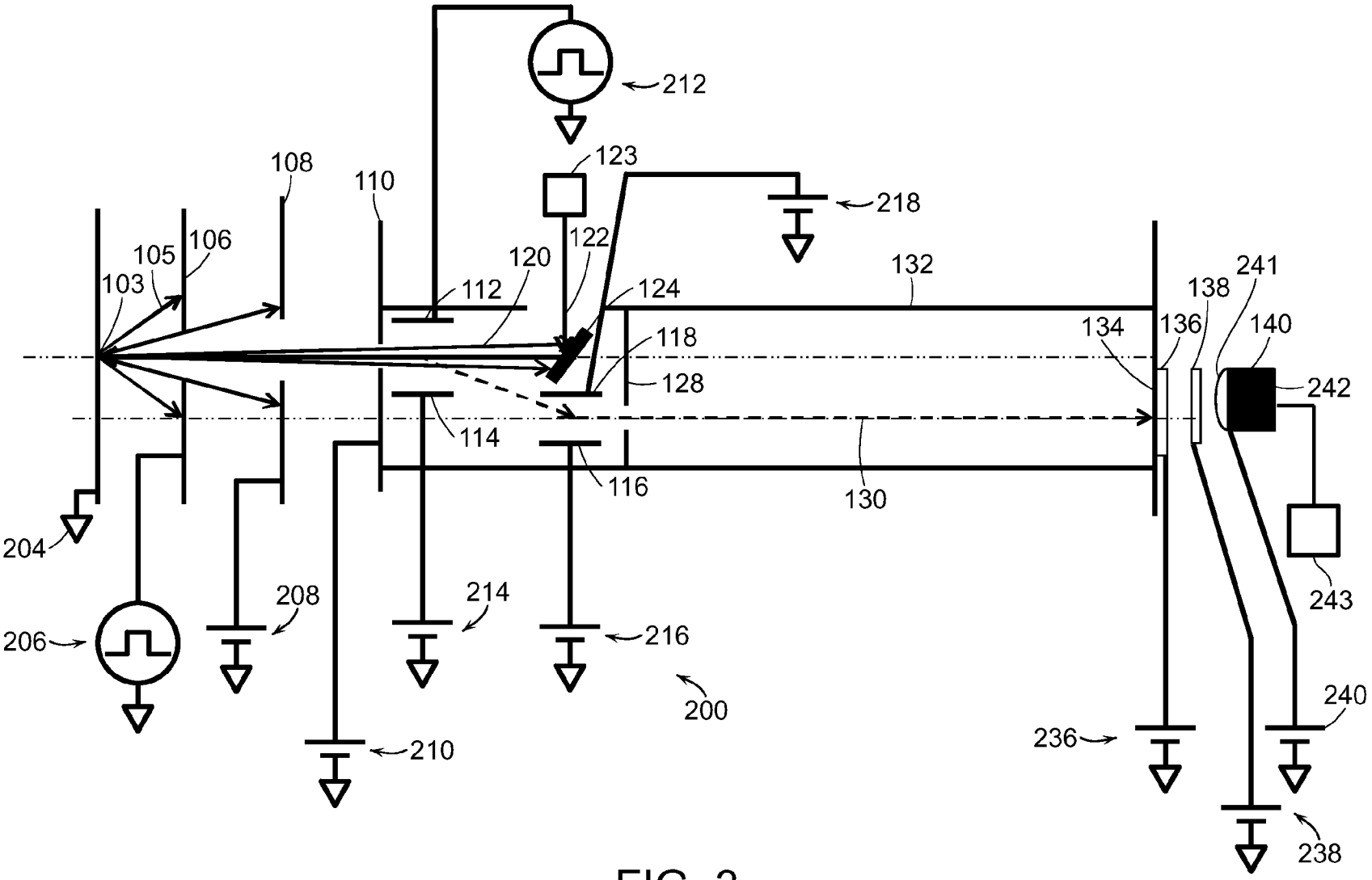
FIG. 3 is a schematic diagram of an ion optical system for a linear time-of-flight mass spectrometer according to one embodiment of the present teaching illustrating the pulsed and static voltages employed during operation.

FIG. 3 is a schematic diagram of an ion optical system for a linear time-of-flight mass spectrometer 200, according to one embodiment of the present teaching, illustrating the pulsed and static voltages employed during operation. The voltage sources used to apply accelerating and deflecting voltages to the pulse of ions 105 are shown. In the embodiment shown in FIG. 3, ground potential 204 is applied to the sample plate 102.

FIG. 3 illustrates outputs of various pulsed and static voltage sources applied to various electrodes in the linear time-of-flight mass spectrometer 200. A pulsed voltage source 206 is applied to extraction electrode 106. A static voltage source 208 is applied to focusing electrode 108. A static voltage source 210 is electrically connected to final acceleration electrode 110. The drift space 132, baffle 128, laser mirror 124, and input 134 to the channel plate detector 136 are also connected to the static voltage source 210. The static voltage source 214 is applied to deflection electrode 114. The static voltage source 216 is applied to deflection electrode 116. The static voltage source 218 is applied to deflection electrode 118. The static voltage source 236 is applied to the output surface of channel plate 136. The pulsed voltage source 212 is applied to deflection electrode 112. The static voltage source 238 is applied to scintillator 138.

The scintillator 138 accelerates electrons emitted by channel plate 136. Light produced by scintillator 138 is focused on the cathode 241 of photomultiplier 140. The static voltage source 240 is applied to the cathode 241 of photomultiplier 140 to accelerate electrons produced in the photomultiplier 140 to anode electrode 242, which is referenced to ground potential through a resistor. The pulsed output of photomultiplier 140 is coupled to a digitizer (not shown). The time interval between the pulsed output of photomultiplier 140 and the pulsed source of ions 105 is recorded by a recording device 243. The mass/charge ratio of detected ions is determined from the time interval using equations known in the art.

In some embodiments, as shown in FIG. 3, ground potential 204 is applied to the sample plate 102 and the anode electrode 242 is referenced to ground potential through a resistor. In other embodiments, the output of the ion detector, the output of the pulsed ion accelerator electrode, and the sample plate are electrically connected to a common potential other than ground potential. In one embodiment, the common potential is a positive voltage. In another embodiment, the common potential is a negative voltage. In yet another embodiment, the output of the ion detector, the pulsed ion accelerator electrode, and the sample plate are all electrically connected to the common potential through a resistance. In one embodiment, the output of the ion detector is electrically connected to the common potential through a first resistor, the pulsed ion accelerator electrode is electrically connected to the common potential through a second resistor, and the sample plate is electrically connected to the common potential through a third resistor.

One skilled in the art will appreciate that there are many variations of the time-of-flight mass spectrometer according to the present teaching. In various embodiments, additional elements such as ion mirrors, ion deflectors, ion lenses, timed-ion selectors, and pulsed accelerators can be included in the evacuated drift space 132 to improve the resolution of mass spectra generated, or to provide additional information about the ions analyzed.

Figure 4:
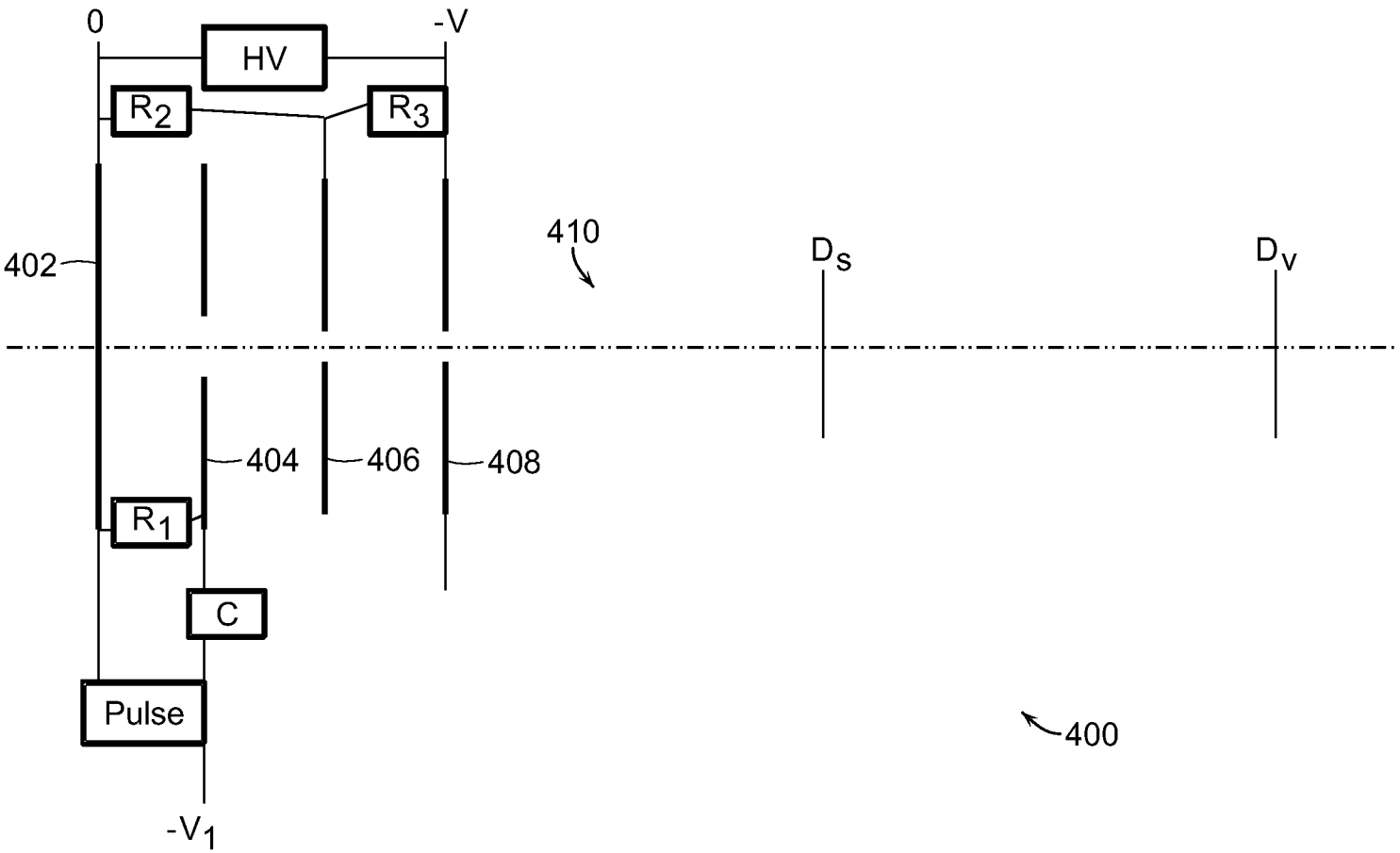
FIG. 4 is a schematic diagram of a pulsed ion accelerator for a time-flight mass spectrometer according to one embodiment of the present teaching.

FIG. 4 is a schematic diagram 400 of a pulsed ion accelerator for a time-flight mass spectrometer according to one embodiment of the present teaching. In this embodiment of the invention, the sample plate 402 is at ground potential, and first acceleration electrode 404 is referenced to ground potential through resistor $R_1$. The resistance value of the resistor $R_1$ is not critical, assuming that a very low DC current flows through electrode 404. For example, in one specific embodiment, the resistance value of the resistor $R_1$ is 10 MΩ. An acceleration pulse with amplitude $-V_1$ is applied to electrode 404 via capacitor C. The capacitance value of the capacitor C is not critical, but is should be large compared to the stray capacitance of electrode 404 referenced to ground potential. In many embodiments, the stray capacitance is less than 100 pF, thus a value of C of 10 nF assures that at least 99% of the applied pulse is effective in accelerating the ions.

A static electric field is formed by applying −V for positive ions to the final accelerating electrode and exit plate 408. The focusing electrode 406 is biased by resistive divider $R_2$ and $R_3$ between −V and ground. The potential on focusing electrode 406 is adjusted to focus the beam traveling through drift space 410 into a parallel beam. The focal distances $D_s$ and $D_v$ can be estimated by the equations for uniform fields that are known in the art. More accurate determinations of both the spatial and time focusing conditions can be determined using an ion optical program, such as SIMION. SIMION is a commercially available electron and ion/electron optics simulation program marketed by Scientific Instrument Services, Inc., in New Jersey. Approximate equations for calculating the focal distances are:

$$D_s=2wf \text{ and } D_v-D_s(2w)^2/(v_n\tau),$$

where w=V/(dV/dx), and f is the effective length of the static accelerating field that can be determined from SIMION calculations or can be estimated from uniform field approximations of the actual accelerating field. In one embodiment w=70, f=2, $V_1$=20 kV, $D_v$=1500 mm, and dV/dx=0.3 kV/mm.

Figure 5:
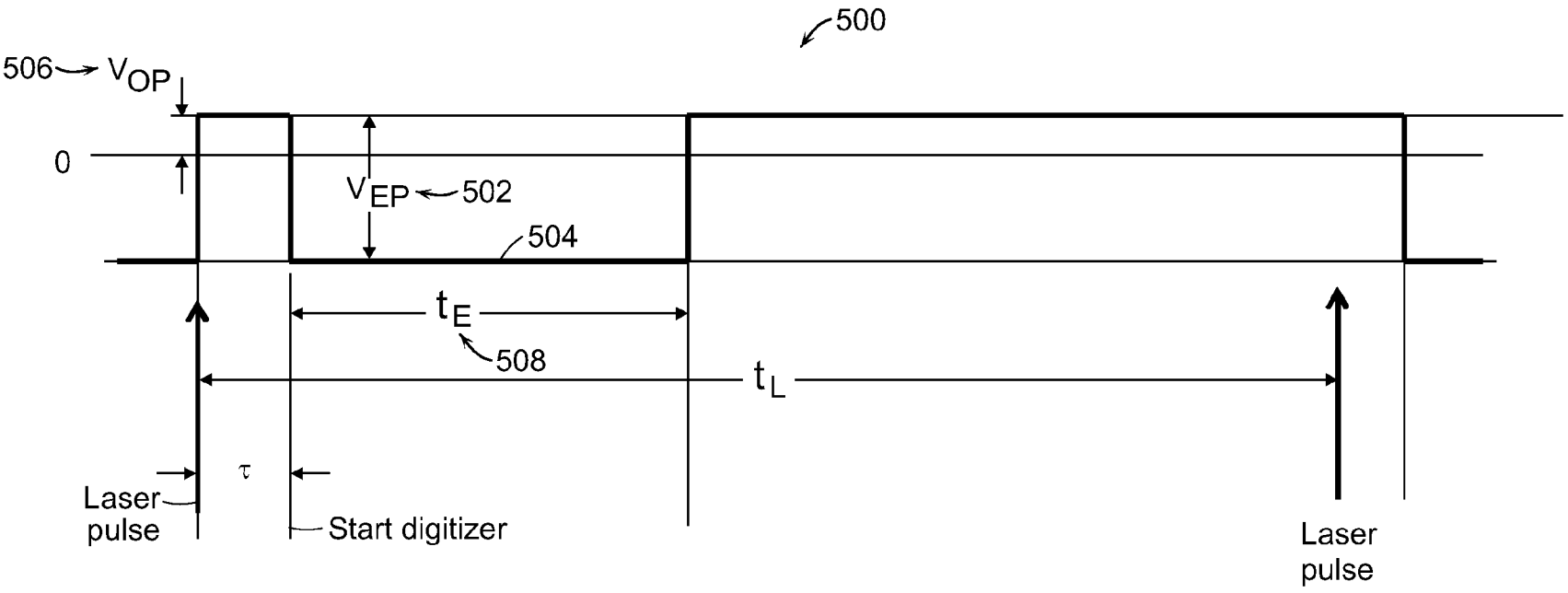
FIG. 5 illustrates a potential and timing diagram for one embodiment of a method of operating a pulsed ion accelerator for a time-of-flight mass spectrometer according to the present teaching.

FIG. 5 illustrates a potential and timing diagram 500 for one embodiment of a method of operating a pulsed ion accelerator for a time-of-flight mass spectrometer according to the present teaching. Referring to FIGS. 4 and 5, in this embodiment, the sample plate 402 and the accelerating electrode 404 are at the same DC potential. A high voltage pulse generator generates a negative accelerating voltage pulse 502 of amplitude $V_{EP}$ that is coupled through capacitor C to first accelerating electrode 404. A DC voltage 504 is applied to the first accelerating electrode 404 and is held at ground potential by resistor $R_1$ so that the average potential of the variable voltage is zero.

For square pulses, such as those illustrated in FIG. 5, it is required that $(V_{EP}-V_{OP})t_E=V_{OP}t_L$. Therefore, the positive operating voltage $V_{OP}=V_{EP}\,[t_E/(t_E+t_L)]$. The first accelerating electrode 404 is then biased at the operating voltage $V_{OP}$ 506 when the laser fires, and remains at the positive voltage until the accelerating voltage pulse $V_{EP}$ 502 is initiated and the voltage on first accelerating electrode 404 is a negative value with a magnitude of $(V_{EP}-V_{OP})$. Time $t_E$ 508 is long compared to the time that the ions spend in the accelerator. Time $t_E$ 508 can be adjusted to set the operating voltage $V_{OP}$ 506 at a value that is required to maintain a nominally field-free region at the surface of sample plate 402 during the period that ions are produced. The start time for the digitizer (not shown), which is used to record the flight time of ions, is synchronized with initiation of the acceleration voltage pulse $V_{EP}$ 502.

Figure 6A:
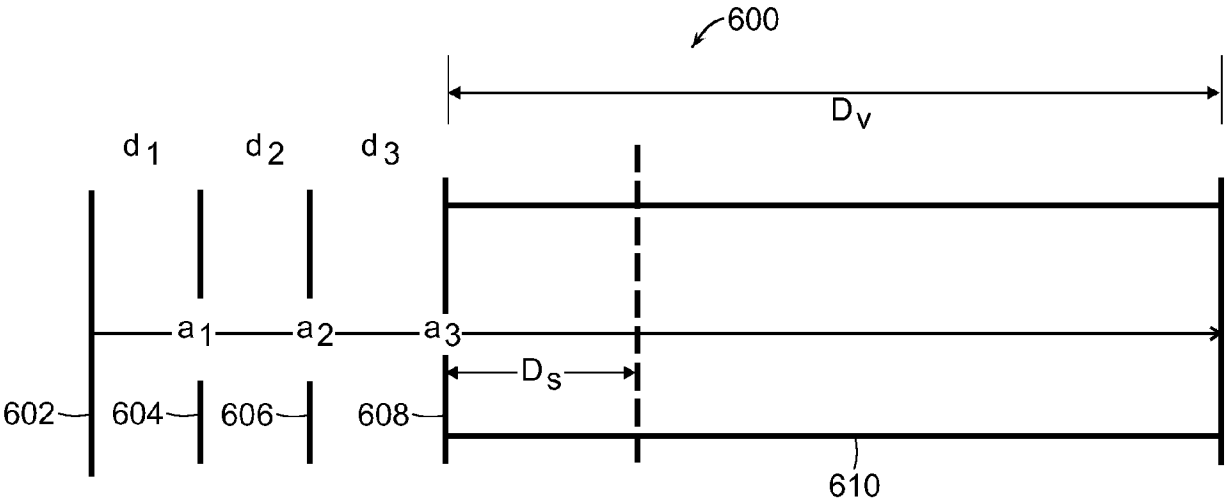
FIG. 6A illustrates a schematic diagram showing an electrode configuration for an ion optical system for a MALDI-TOF mass spectrometer according the present teaching.

FIG. 6A illustrates a schematic diagram showing an electrode configuration 600 for an ion optical system for a MALDI-TOF mass spectrometer according the present teaching. Referring to FIG. 4 and to the associated description, and to FIG. 6A, the electrode configuration 600 shows the sample plate 602, the accelerating electrode 604, the focusing electrode 606, and the final accelerating electrode and exit plate 608. In addition, the field-free region 610 is shown, including the focal length $D_s$ corresponding to the distance that ions travel in the field-free drift space, and the focal length $D_v$ corresponding to the distance that ions travel in the field-free drift space where the flight time to that distance for ions produced with different initial velocities is independent (to first order) of the initial velocity.

Figure 6B:
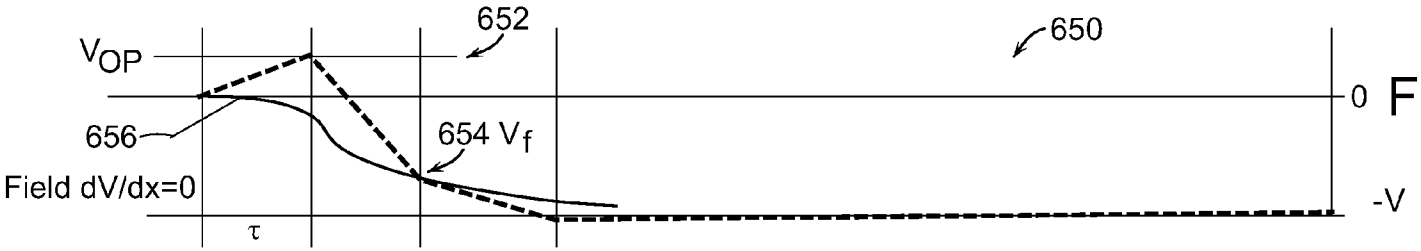
FIG. 6B illustrates a first axial potential diagram for the pulsed ion accelerator configuration shown in FIGS. 4 and 6A corresponding to the capacitively coupled acceleration pulse shown in FIG. 5 and an electric field gradient $dV/dx=0$.

FIG. 6B illustrates a first axial potential diagram 650 for the pulsed ion accelerator configuration shown in FIGS. 4 and 6A corresponding to the capacitively coupled acceleration pulse shown in FIG. 5 and an electric field gradient dV/dx=0. The potential diagram 650 shows that the voltage $V_{OP}$ 652 is applied to the first acceleration electrode 404 so that it maintains a substantially zero electric field at the surface of sample plate 402 during the time that ions are produced. After delay time τ 653 the voltage is switched to $V_f$ 654 in order to produce an electric field gradient dV/dx=0. The corresponding zero voltage gradient dV/dx 656 is shown. Optimal conditions for time focusing, while simultaneously producing a parallel beam of small diameter, can be achieved by proper choice of the distances and aperture sizes, and by adjusting the values of $V_f$, $V_{EP}$, and τ.

Figure 6C:
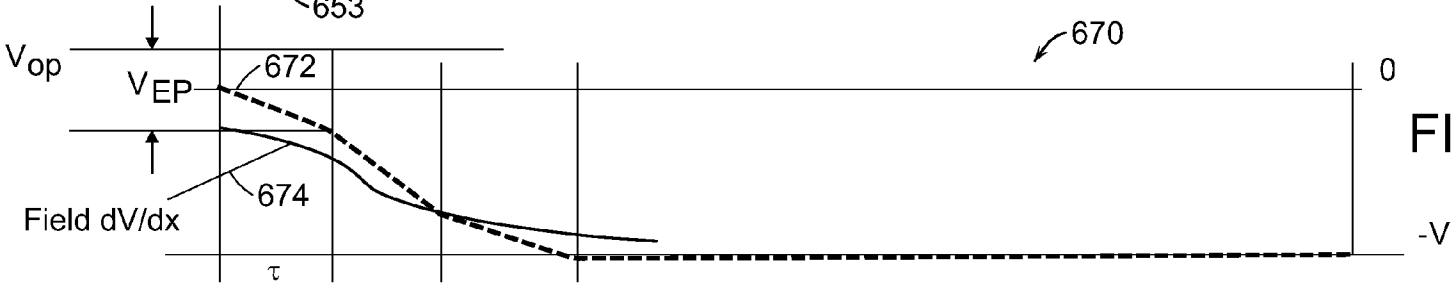
FIG. 6C illustrates a first axial potential diagram for the pulsed ion accelerator configuration shown in FIGS. 4 and 6A corresponding to the capacitively coupled acceleration pulse shown in FIG. 5 and for a finite electric field gradient $dV/dx$.

FIG. 6C illustrates a first axial potential diagram 670 for the pulsed ion accelerator configuration shown in FIGS. 4 and 6A corresponding to the capacitively coupled acceleration pulse shown in FIG. 5 and for a finite electric field gradient dV/dx. The potential diagram 670 shows that after delay time τ, the voltage is switched to $V_{EP}-V_{OP}$ 672 in order to produce an accelerating electric field at the surface of sample plate 402 corresponding to the value of voltage $V_{EP}$. The corresponding finite voltage gradient dV/dx 674 is shown. Optimal conditions for time focusing, while simultaneously producing a parallel beam of small diameter, can be achieved by proper choice of the distances and aperture sizes, and by adjusting the values of $V_f$, $V_{EP}$, and τ.

Figure 7:
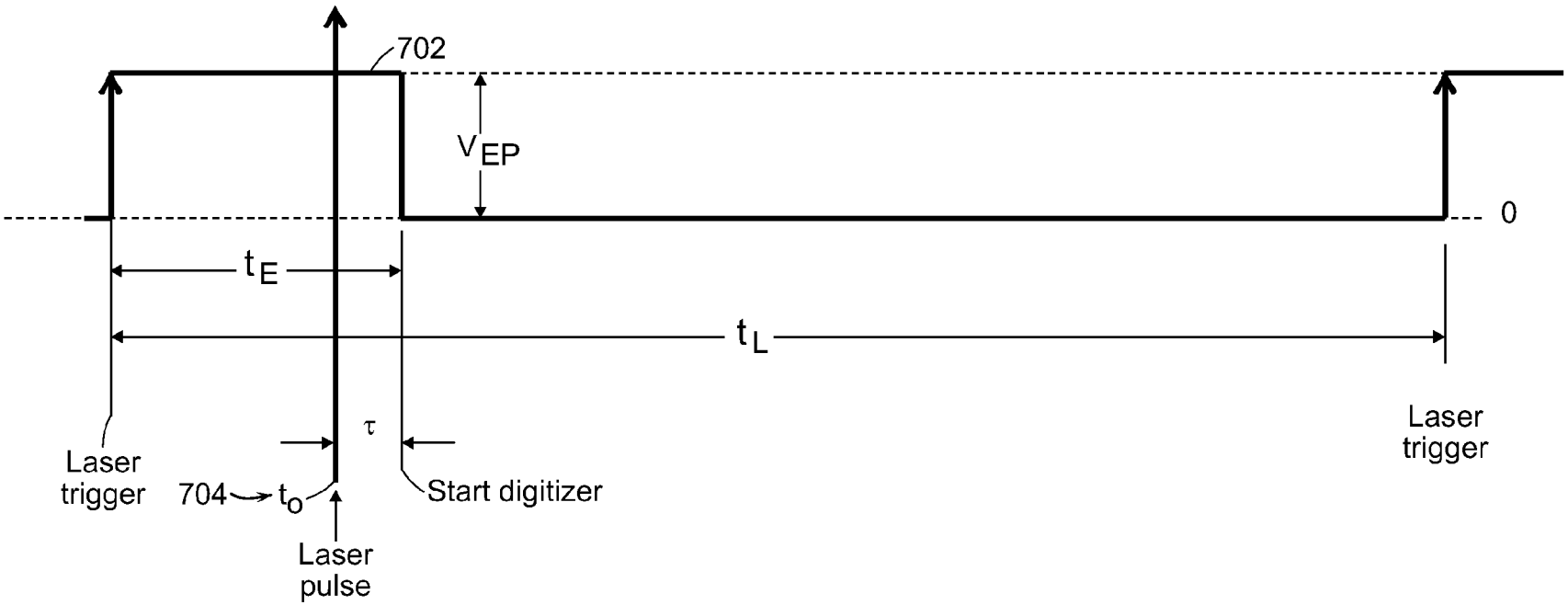
FIG. 7 is a potential and timing diagram for one embodiment of a pulsed ion accelerator for a time-of-flight mass spectrometer, according to the present teaching, wherein an accelerating pulse is directly coupled to the accelerating electrode and where the sample plate and the accelerating electrode are at the same DC potential when the amplitude of the accelerating pulse is zero.

FIG. 7 is a potential and timing diagram 700 for one embodiment of a pulsed ion accelerator for a time-of-flight mass spectrometer, according to the present teaching, where an accelerating pulse is directly coupled to the accelerating electrode 404 (FIG. 4) and where both the sample plate 402 and the accelerating electrode 404 are at the same DC potential when the amplitude of the accelerating pulse is zero. In the embodiment shown in FIG. 7, capacitive coupling between the pulsed accelerating voltage and electrode 404 is replaced by direct coupling. In these embodiments, the apertures and distances are adjusted to provide optimum performance with the accelerating electrode 404 at ground potential during the time that ions are accelerated.

A positive voltage pulse 702 having amplitude $V_{EP}$ is applied to the accelerating electrode 404 (FIG. 4) before a laser pulse is triggered at time $t_0$ 704 and terminates at a predetermined time τ 706. The value of voltage pulse $V_{EP}$ 702 is chosen to provide a substantially zero accelerating field at the surface of sample plate 402 during the time that ions are produced. The digitizer is initiated after time τ 706.

Figures 8A, 8B, 8C:
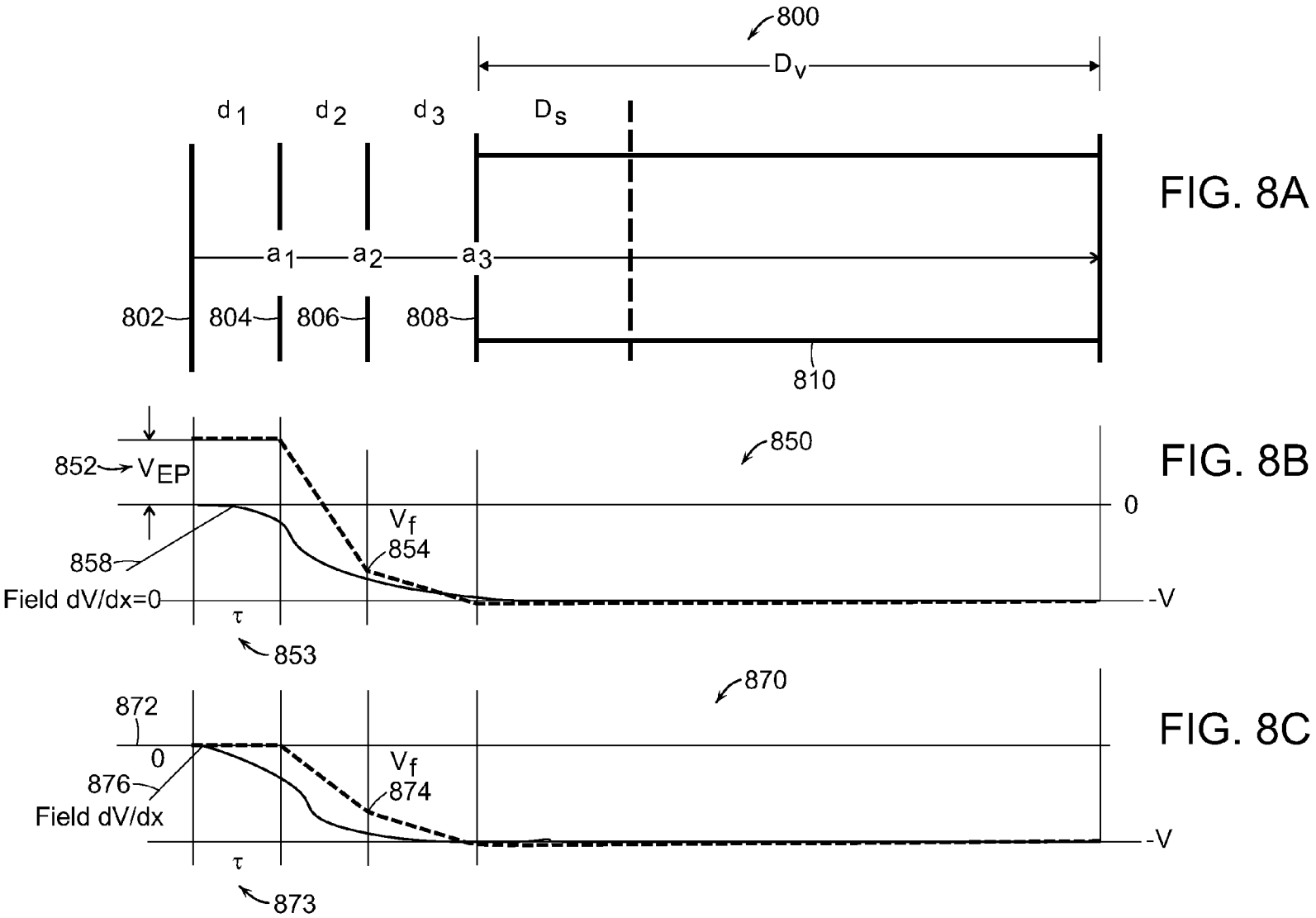
FIG. 8A illustrates a schematic diagram showing an electrode configuration 800 for an ion optical system for a MALDI-TOF mass spectrometer according the present teaching.
FIG. 8B illustrates an axial potential diagram for the pulsed ion source illustrated in FIG. 4, with the directly coupled acceleration pulse described in connection with FIG. 7 and an electric field gradient dV/dx=0.
FIG. 8C illustrates an axial potential diagram for the pulsed ion source illustrated in FIG. 4, with the directly coupled acceleration pulse described in connection with FIG. 7 and a finite electric field gradient dV/dx.

FIG. 8A illustrates a schematic diagram showing an electrode configuration 800 for an ion optical system for a MALDI-TOF mass spectrometer according the present teaching. Referring to FIG. 4 and to the associated description, the electrode configuration 800 shows the sample plate 802, the accelerating electrode 804, the focusing electrode 806, and the final accelerating electrode and exit plate 808. In addition, the field-free region 810 is shown, including the focal length $D_s$ corresponding to the distance that ions travel in the field-free drift space and the focal length $D_v$ corresponding to the distance that ions travel in the field-free drift space where the flight time to that distance for ions produced with different initial velocities is independent (to first order) of the initial velocity.

FIG. 8B illustrates an axial potential diagram 850 for the pulsed ion source illustrated in FIG. 4, with the directly coupled acceleration pulse described in connection with FIG. 7 and an electric field gradient dV/dx=0. The potential diagram 850 shows that the Voltage $V_{EP}$ 852 is applied to electrode 404 and is maintained at a substantially zero electric field at the surface of sample plate 402 during the time that ions are produced. After delay time τ 853, the voltage is switched to $V_f$ 854 to produce an accelerating electric field gradient 858 dV/dx=0 at the surface of sample plate 402. Optimal conditions for time focusing, while simultaneously producing a parallel beam of small diameter, can be achieved by proper choice of the distances and aperture sizes, and by adjusting the values of $V_f$ 854, $V_{EP}$ 852, and τ 853.

FIG. 8C illustrates an axial potential diagram 870 for the pulsed ion source illustrated in FIG. 4, with the directly coupled acceleration pulse described in connection with FIG. 7 and a finite electric field gradient dV/dx. Referring to both FIGS. 4 and 8C, the potential diagram 870 shows that a zero voltage 872 is applied to electrode 404 and is maintained at a substantially zero electric field at the surface of sample plate 402 during the time that ions are produced. After delay time τ 873, the voltage is switched to $V_f$ 874 to produce an accelerating electric field gradient 876 dV/dx at the surface of sample plate 402. Optimal conditions for time focusing, while simultaneously producing a parallel beam of small diameter, can be achieved by proper choice of the distances and aperture sizes, and by adjusting the values of $V_f$ 874, and τ 853.

Figure 9:
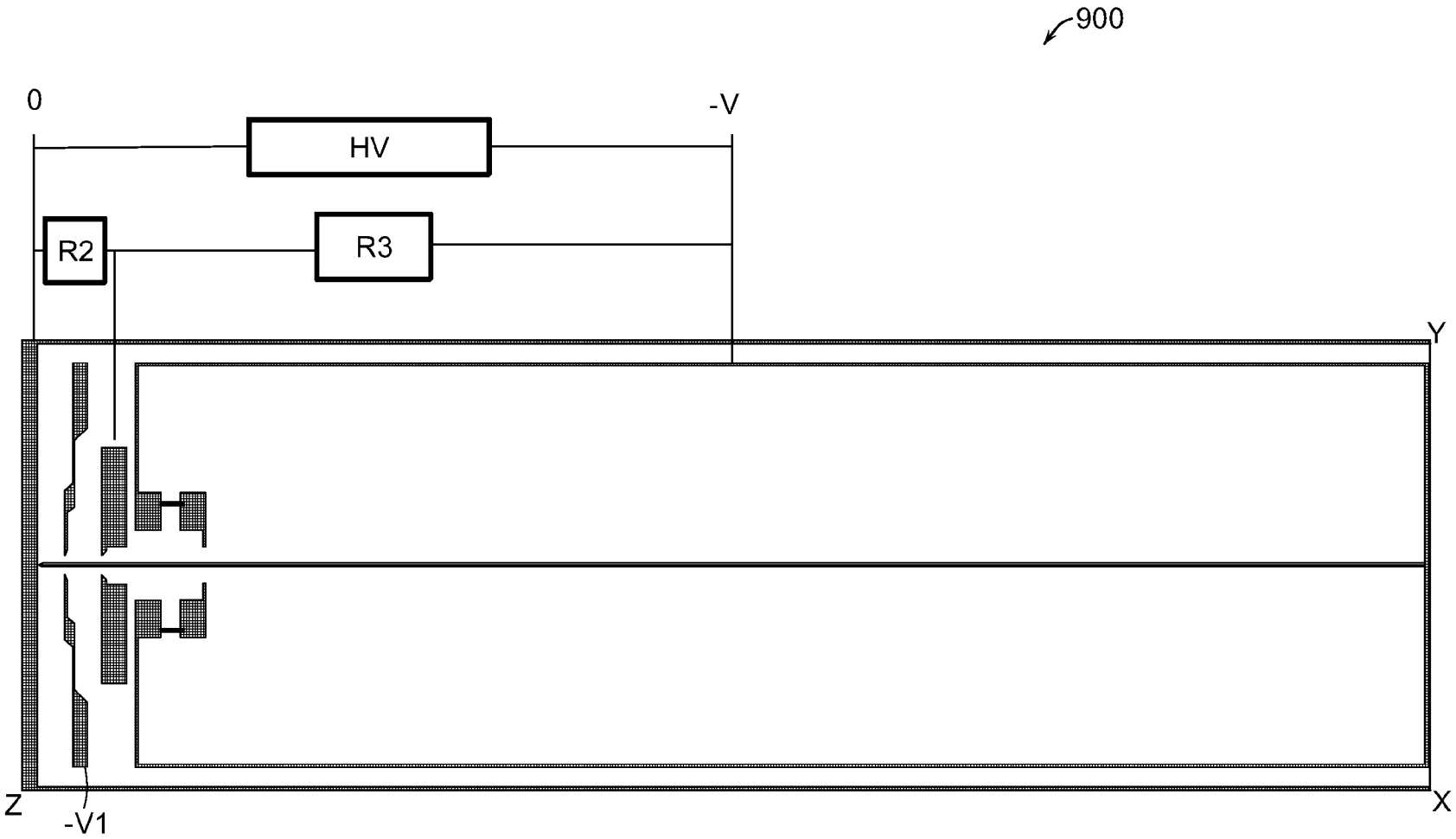
FIG. 9 illustrates simulation data generated from SIMION for an ion optical system according to the present teaching.

FIG. 9 illustrates simulation data 900 generated from SIMION for an ion optical system according to the present teaching. Data is presented for a set of optimized aperture diameters, accelerator electrode spacings, electric field strengths, and time delays that simultaneously produce a substantially parallel ion beam and also minimizes the variation in flight time due to differences in initial velocity.

Figure 10:
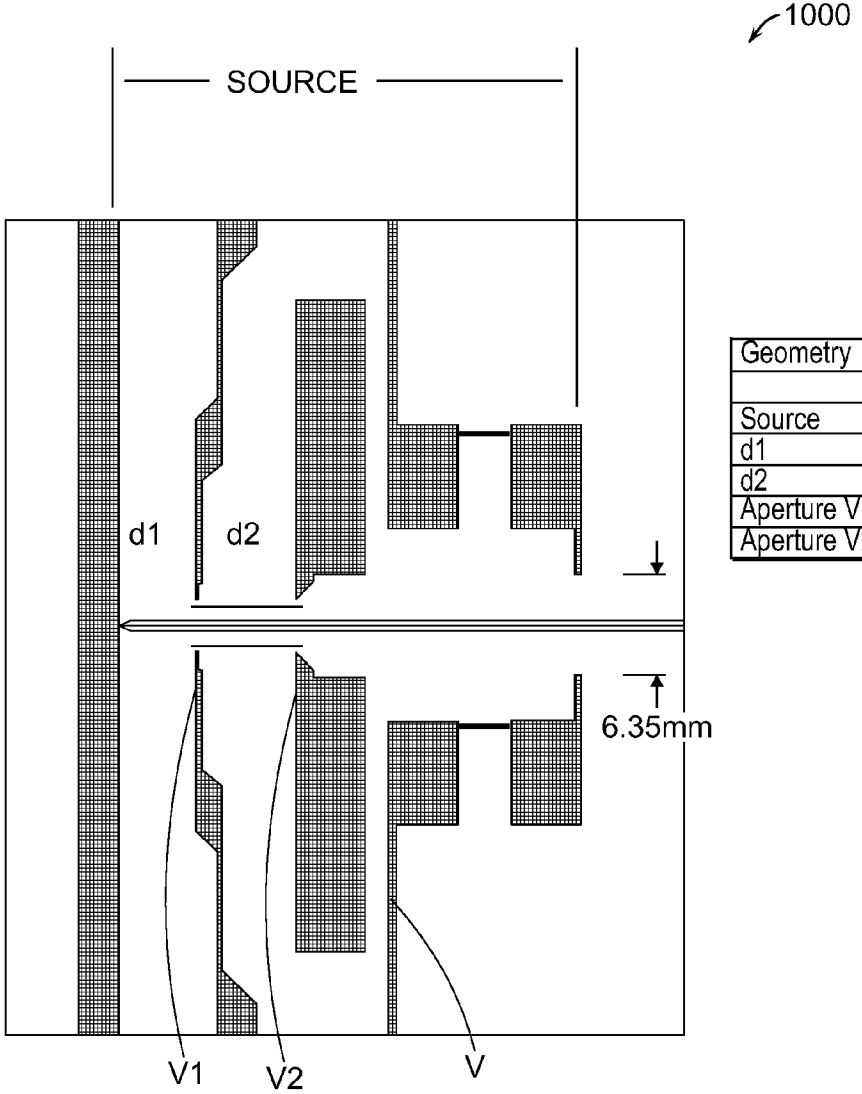
FIG. 10 illustrates an expanded view of the data generated by SIMION in the ion source region, which is shown in FIG. 9 for a given set of apertures, dimensions and voltages.

FIG. 10 illustrates an expanded view of the data 100 generated by SIMION in the ion source region, which is shown in FIG. 9 for a given set of apertures, dimensions, and voltages. SIMION calculations are used to determine the optimum field strengths and time delays required to simultaneously produce a substantially parallel ion beam as shown in FIG. 9, and also to minimize the variation in flight time due to differences in initial position and velocity. The data in FIG. 10 show that for a given set of apertures and dimensions, SIMION can determine the optimum field strengths and time delays required to simultaneously produce a substantially parallel ion beam, and also to minimize the variation in flight time due to differences in initial position and velocity.

Figure 11A:
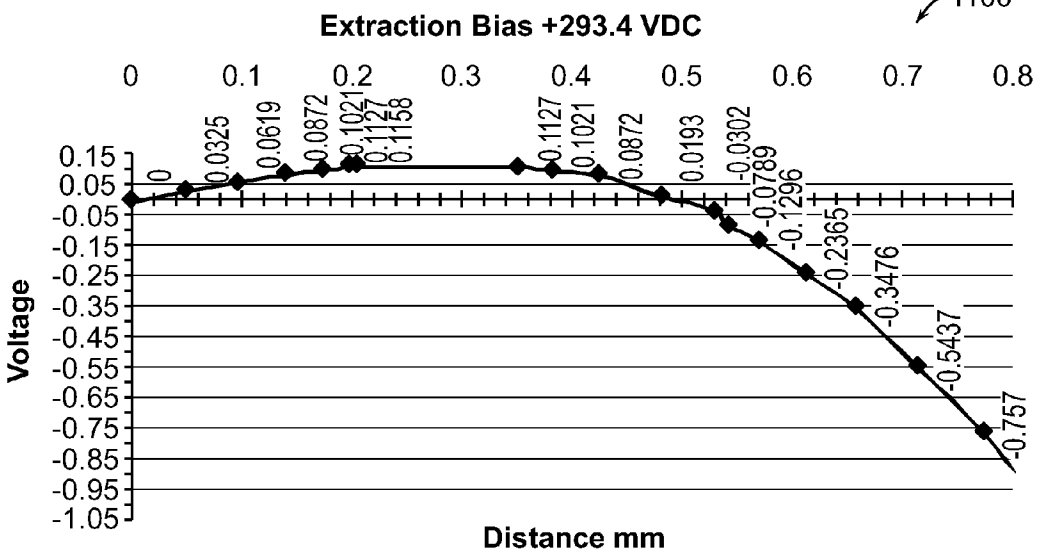
FIGS. 11A and 11B present the potential distribution near a MALDI ion source for two values of a potential applied to the acceleration electrode during the time that ions are formed and prior to application of the accelerating pulse.
Figure 11B:
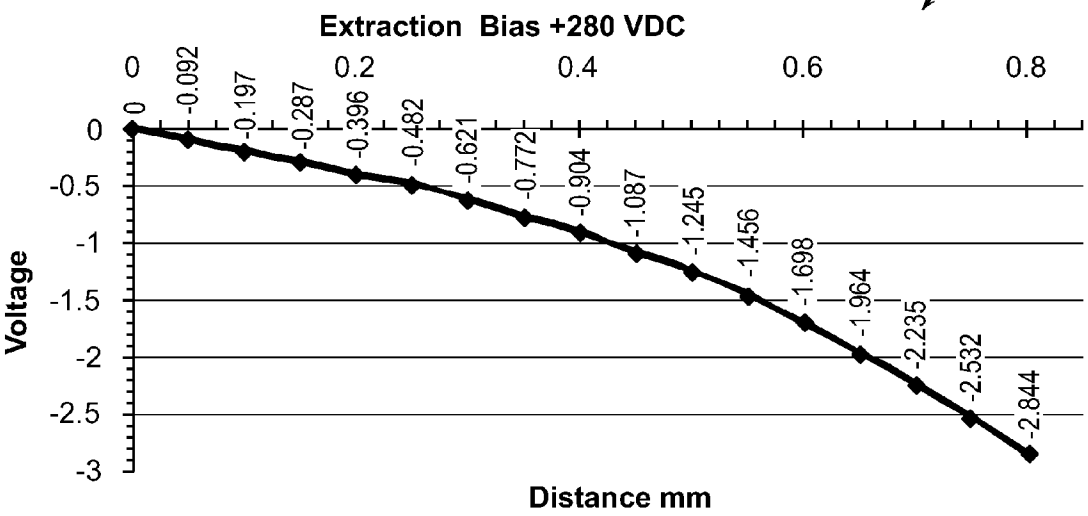

FIGS. 11A and 11B present the potential distribution near a MALDI ion source for two values of a potential applied to the acceleration electrode 404 (FIG. 4) during the time that ions are formed and prior to application of the accelerating pulse. More specifically, FIG. 11A presents potential distribution data 1100 showing voltage as a function of position for an extraction bias voltage of +145 VDC.

FIG. 11B presents potential distribution data 1150 showing voltage as a function of position for an extraction bias voltage of +130 VDC. To provide proper time focusing, as described by Wiley and McLaren, it is desirable that the potential gradient at the surface of MALDI ion source be zero during the time that the ions are produced. Interpolation of the results shown in FIGS. 11A and 11B indicates that time focusing is achieved for a retarding potential of approximately 138 V with 20 kV total acceleration.

Figure 12A:
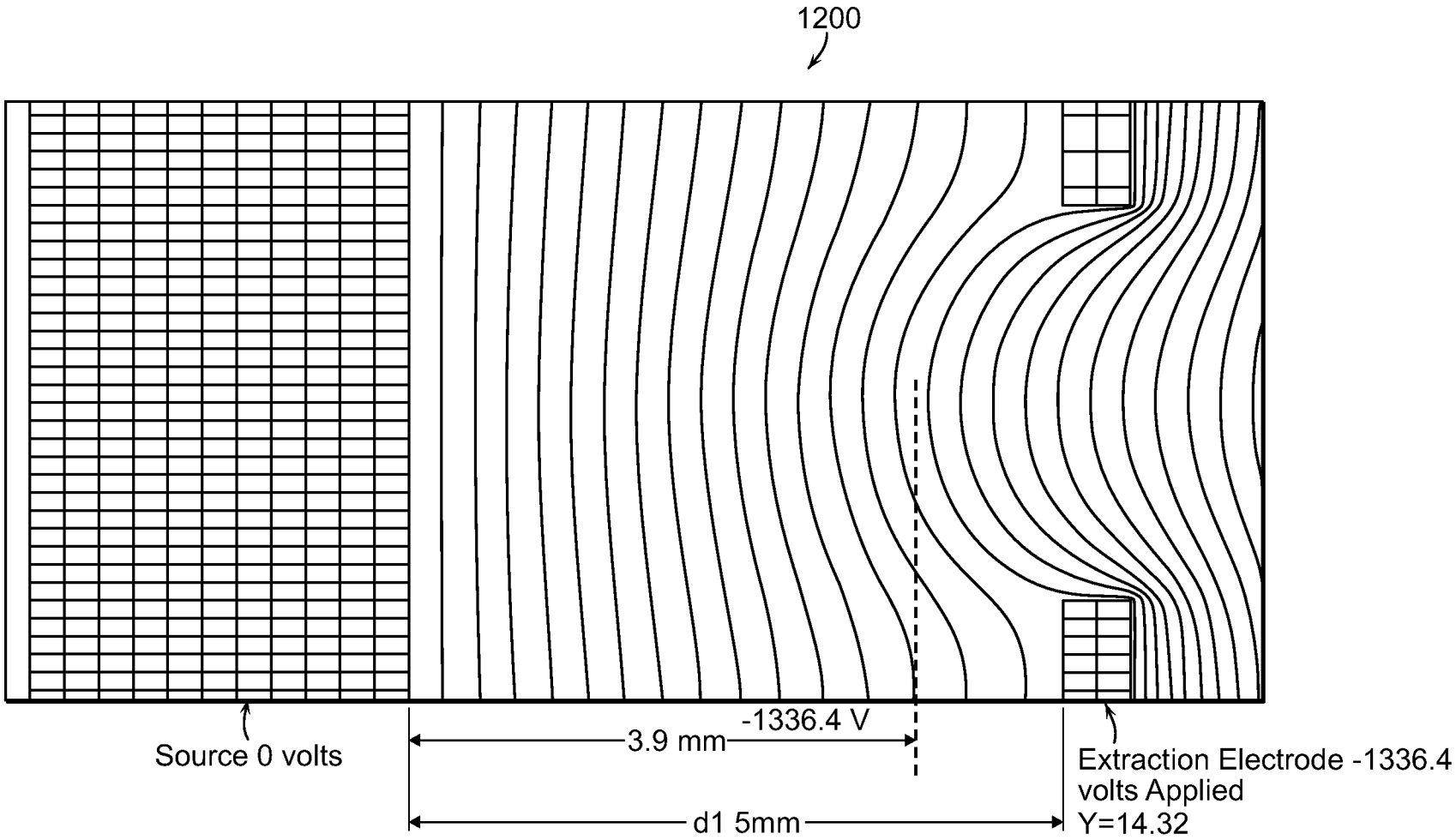
FIG. 12A illustrates an axial electric field line diagram showing an optimal axial potential for an embodiment of a time-of-flight mass spectrometer, according to the present teaching, during the time period where ions are accelerated by an electric field generated after the application of an accelerating pulse to the acceleration electrode.

FIG. 12A illustrates an axial electric field line diagram 1200 showing an optimal axial potential for an embodiment of a time-of-flight mass spectrometer according to the present teaching during the time period where ions are accelerated by an electric field generated after the application of an accelerating pulse to the acceleration electrode 406 (FIG. 4). More specifically, FIG. 12A shows the potential distribution for an accelerating voltage of 2 kV applied to the acceleration electrode 404 (FIG. 4). This potential distribution, together with a focusing voltage of −12.5 kV, provides the spatial focusing of the ion beam that was illustrated in FIG. 9.

Figure 12B:
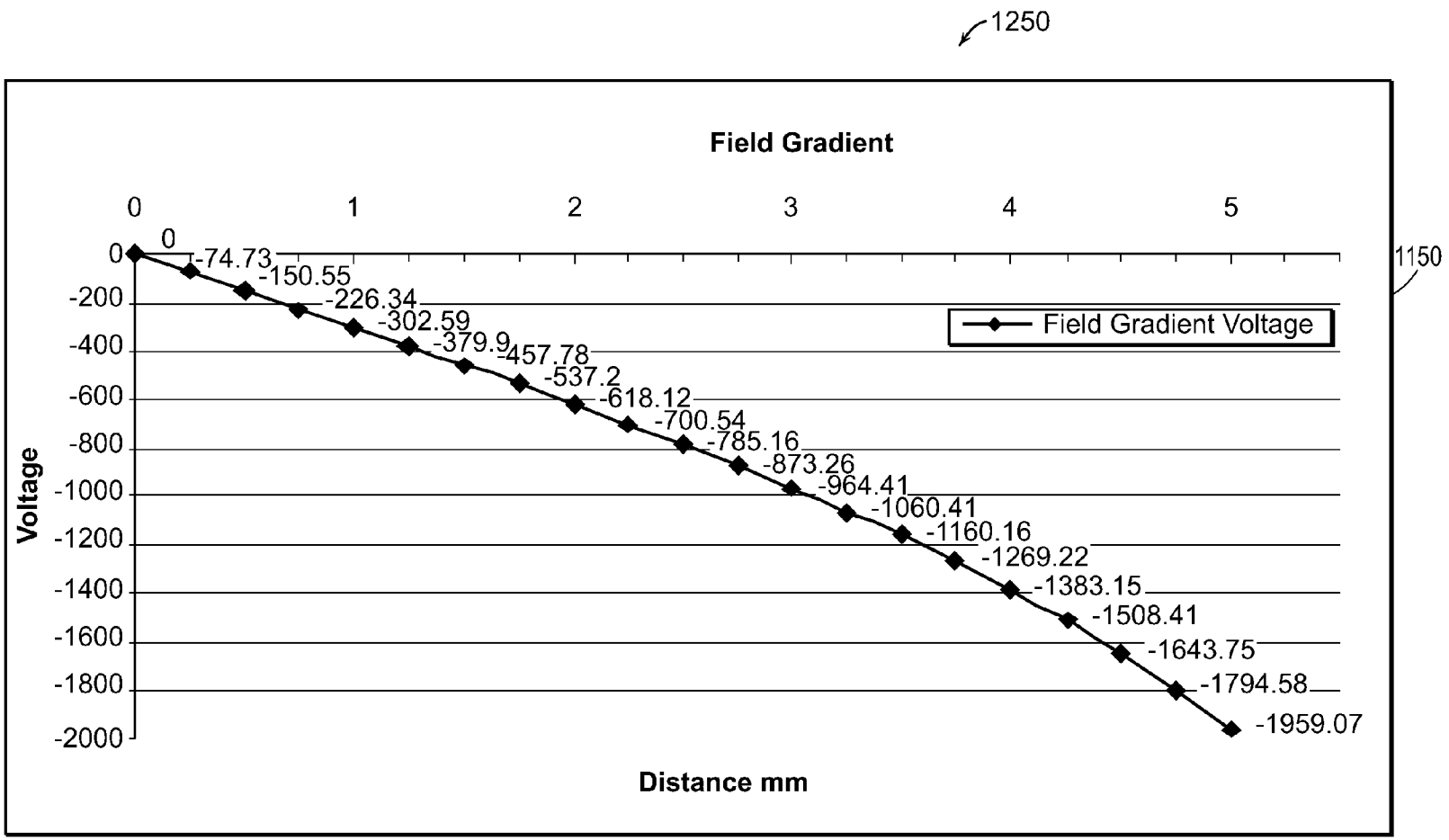
FIG. 12B illustrates an electric field gradient diagram showing the voltage as a function of position for the optimal axial potential shown in FIG. 12A.

FIG. 12B illustrates an electric field gradient diagram 1250 showing the voltage as a function of position for the optimal axial potential shown in FIG. 11A. The time focusing conditions can be calculated using equations developed by Wiley and McLaren with a voltage ratio y=20/2=10 and an effective length of the first field of 5 mm. Calculations of focusing conditions using the uniform field approximation agree with those calculated from SIMION to within 0.3 mm at a total drift distance of 800 mm. The delay between the laser pulse and the acceleration pulse for focus at any particular mass can then be determined with sufficient accuracy by using the uniform field approximation. These calculations indicate that the desired focusing conditions can be achieved in one particular embodiment with a retarding potential of approximately 138 V prior to the extraction pulse, and with a pulse amplitude of approximately 2k V. Referring now to FIG. 5, these voltages correspond to a duty cycle of 138/2000=0.069. Thus, for 1 kHz operation of the laser, $t_E$=69 microseconds.

Figure 13:
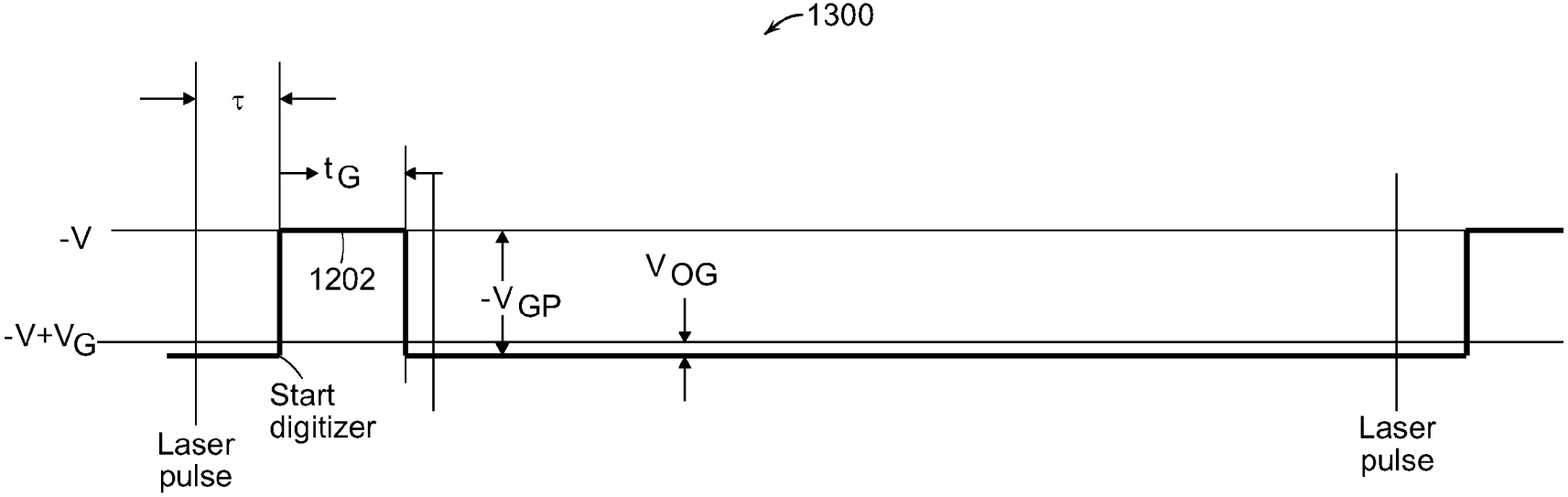
FIG. 13 illustrates a pulsed voltage waveform that is applied to a gate electrode in one method of operating a time-of-flight mass spectrometer, according to the present teaching, where the waveform is capacitively coupled to the pulsed deflection electrodes shown in FIGS. 2 and 3.

FIG. 13 illustrates a pulsed voltage waveform 1300 that is applied to a gate electrode in one method of operating a time-of-flight mass spectrometer, according to the present teaching, where the waveform 1300 is capacitively coupled to the pulsed deflection electrodes 112 and 114 shown in FIGS. 2 and 3. Referring back to the ion optical system configuration described in connection with FIG. 2, the first set of deflection electrodes 112 and 114, and the second set of deflection electrodes 116 and 118, deflect a selected portion of the pulse of ions 130 away from the beam of neutrals 120, and also direct the selected pulse of ions 130 through aperture 126 in baffle 128 into the field-free evacuated drift region 132. In the embodiment shown in FIG. 2, the laser beam 122 is essentially coaxial with the ion beam.

In various embodiments, many electrode voltages are derived from resistive voltage dividers connected to a single power supply, such as a −20 kV power supply, as described in connection with FIG. 4. However, in one particular embodiment, a −2 kV voltage pulse is applied to the extraction electrode 106, a 500 V voltage pulse is applied to the deflection electrodes 112 and 114, and a −600 V DC voltage is applied to the photomultiplier. In one embodiment, the output voltages of the various power supplies are set at the factory, and no tuning or adjustment by the operator are required. The voltages shown in FIG. 13 are for positive ions. For negative ions, the polarity of the 20 kV power supply, and the polarity of the 2 kV pulse, are reversed, but the voltage applied to deflection electrodes 112 and 114 and to the photomultiplier are unchanged. For positive ions, the scintillator is at ground potential, and for negative ions, it is increased to about +30 kV to accelerate electrons from the channel plate to the scintillator. Also, the +20 kV is applied directly to the output of the channel plate, and the inputs to other elements are reduced to 19 kV using the resistive divider.

In one method of operation according to the present teaching, the pulsed voltage waveform 1300 is capacitively coupled to at least one of the first set of deflection electrodes 112 and 114 (FIGS. 2 and 3). In this method of operation, the pulsed voltage waveform 1300 directs the ion beam away from the second set of deflection electrodes 116, 118, thereby preventing a selected set of ions from being transmitted to the detector. In one embodiment, the timing of the pulsed voltage waveform 1300 is chosen so that all ions with mass/charge ratio values less than a predetermined value are removed from the transmitted beam.

Since the waveform 1300 is capacitively coupled to the deflection electrodes 112 and 114 (FIGS. 2 and 3), the average voltage over a cycle is zero. This configuration causes ions with greater than a predetermined mass/charge ratio to be deflected to pass to the detector, while lower mass/charge ratio ions are removed by a baffle plate. Thus, the ratio $V_{OG}/-V_{GP}$ is equal to the duty cycle $t_G/t_L$. The DC potential applied between electrodes 112 and 114 is chosen to direct the ions toward second deflectors 116 and 118. When the gate pulse $V_{GP}$ is used to remove unwanted low mass ions, the voltage is switched on at the same time as the extraction pulse is applied, and switched off at the time that the lowest mass of interest reaches the entrance to first deflectors 112 and 114.

In one embodiment employing −20 kv acceleration, deflection voltages of + and −700 volts are applied to the deflection electrodes, and a pulse of amplitude approximately −1.4 kV is applied to the more positive deflection electrode to direct the unwanted ions away. Typically, the time that the negative pulse is applied is less than 5 microseconds, so even for fast state-of-the-art lasers, operating in the rage of 5 kHz, the offset voltage $V_{OG}$ is negligible.

EQUIVALENTS

While the Applicant's teaching is described in conjunction with various embodiments, it is not intended that the Applicant's teaching be limited to such embodiments. On the contrary, the Applicant's teaching encompass various alternatives, modifications, and equivalents, as will be appreciated by those of skill in the art, which may be made therein without departing from the spirit and scope of the teaching.

We claim:

1. An ion accelerator for a time-of-flight mass spectrometer, the ion accelerator comprising:

a) a pulsed ion accelerator positioned proximate to a sample plate, the pulsed ion accelerator comprising an electrode electrically connected to the sample plate;

b) an accelerator power supply having an output electrically connected to the pulsed ion accelerator electrode, the accelerator power supply generating an accelerating potential on the ion accelerator electrode that accelerates a pulse of ions generated from the sample positioned on the sample plate;

c) an ion focusing electrode positioned after the pulsed ion accelerator, wherein a potential applied to the ion focusing electrode focuses the pulse of ions into a substantially parallel beam propagating in an ion flight path; and d) a static ion accelerator positioned proximate to the ion focusing electrode and having an input that receives the pulse of ions focused by the ion focusing electrode, the static ion accelerator accelerating the focused pulse of ions.

2. The ion accelerator of claim 1 wherein the sample plate comprises a MALDI sample plate.

3. The ion accelerator of claim 1 wherein the accelerator power supply is capacitively coupled to the pulsed ion accelerator electrode.

4. The ion accelerator of claim 1 wherein the accelerator power supply is directly coupled to the pulsed ion accelerator electrode.

5. The ion accelerator of claim 1 wherein a pulsed laser source generates ions from the sample positioned on the sample plate.

6. The ion accelerator of claim 1 further comprising a first and second pair of ion deflectors that are positioned in a field-free region after the static ion accelerator, the first and second pair of ion deflectors directing selected ions with mass/charge ratio values greater than a predetermined minimum value to an ion detector and preventing ions with mass/charge ratio values less than the predetermined minimum value from reaching the detector.

7. The spectrometer of claim 6 further comprising a pulsed voltage power supply having an output that is capacitively coupled to the pair of ion deflectors positioned in the field-free region.

8. The spectrometer of claim 6 further comprising a pulsed voltage power supply having an output that is directly coupled to the pair of ion deflectors positioned in the field-free region.

9. A time-of-flight mass spectrometer comprising:

a) a sample plate that supports a sample for analysis;

b) a pulsed ion accelerator positioned proximate to the sample plate, the pulsed ion accelerator comprising an electrode electrically connected to the sample plate;

c) an accelerator power supply having an output electrically connected to the pulsed ion accelerator, the accelerator power supply generating an accelerating potential that accelerates the pulse of ions produced from the sample positioned on the sample plate;

d) an ion focusing electrode positioned after the pulsed ion accelerator, wherein a potential applied to the ion focusing electrode focuses the pulse of ions into a substantially parallel beam propagating in an ion flight path;

e) a static ion accelerator positioned proximate to the ion focusing electrode and having an input that receives the pulse of ions focused by the ion focusing electrode, the static ion accelerator accelerating the focused pulse of ions;

f) a field-free region positioned in the ion flight path after the static ion accelerator; and g) an ion detector having an input in the ion flight path of the focused and accelerated ions propagating in the field-free region, and having an output that is electrically connected to the sample plate, the ion detector converting the detected ions into a pulse of electrons.

10. The ion accelerator of claim 9 wherein the pulsed ion accelerator comprises an electrode electrically connected to the sample plate by a resistor.

11. The ion accelerator of claim 10 wherein the resistor has resistance between 1 and 10 megohms.

12. The spectrometer of claim 9 wherein the ion detector comprises:

a) a channel plate detector that converts the pulse of ions into a first pulse of electrons;

b) a scintillator that receives the first pulse of electrons from the channel plate detector and that generates a pulse of light in response to the pulse of electrons emitted by the channel plate detector; and c) a photomultiplier positioned to receive the light generated by the scintillator, the photomultiplier generating a second pulse of electrons having an amplitude that is proportional to the number of detected ions.

13. The mass spectrometer of claim 12 wherein the output of the ion detector, the output of the pulsed ion accelerator electrode, and the sample plate are electrically connected to a common potential.

14. The mass spectrometer of claim 13 wherein the common potential is equal to ground potential.

15. The mass spectrometer of claim 13 wherein the common potential is a positive voltage.

16. The mass spectrometer of claim 13 wherein the common potential is a negative voltage.

17. The mass spectrometer of claim 13 wherein the output of the ion detector, the pulsed ion accelerator electrode, and the sample plate are all electrically connected to the common potential through a resistance.

18. The mass spectrometer of claim 13 wherein the output of the ion detector is electrically connected to the common potential through a first resistor, the pulsed ion accelerator electrode is electrically connected to the common potential through a second resistor, and the sample plate is electrically connected to the common potential through a third resistor.

19. The mass spectrometer of claim 13 further comprising a recording device having an input that is electrically connected to the output of the ion detector and being electrically connected to the common potential.

20. The mass spectrometer of claim 9 further comprising a recording device having an input that is electrically connected to the output of the ion detector.

21. The mass spectrometer of claim 9 further comprising a pulsed laser source that generates ions from the sample positioned on the sample plate.

22. The mass spectrometer of claim 9 further comprising a final accelerating electrode positioned proximate to the ion focusing electrode.

23. A method of accelerating ions in a time-of-flight mass spectrometer, the method comprising:

a) accelerating a pulse of ions generated from a sample by applying a voltage to an accelerator electrode;

b) applying a static electric field proximate to the pulse of ions that accelerates the pulse of ions; and c) focusing the accelerated pulse of ions into a substantially parallel beam that propagates in an ion flight path.

24. The method of claim 23 wherein the sample comprises a MALDI sample.

25. The method of claim 23 wherein the voltage applied to an accelerator electrode is capacitively coupled to the accelerator electrode.

26. The method of claim 23 wherein the voltage applied to an accelerator electrode is directly coupled to the accelerator electrode.

27. The method of claim 23 further comprising generating the pulse of ions with a pulse of light.

28. The method of claim 23 further comprising selecting ions with mass/charge ratio values greater than a predetermined minimum value.

29. The method of claim 23 further comprising directing selected ions with mass/charge ratio values greater than a predetermined minimum value through an aperture in a baffle.

30. The method of claim 23 further comprising detecting the selected ions with mass/charge ratio values greater than a predetermined minimum value and preventing ions with mass/charge ratio values less than the predetermined minimum value from being detected.

31. The method of claim 23 further comprising accelerating the focused accelerated pulse of ions.

* * * * *